US005584341A

United States Patent [19]

Sabin et al.

[11] Patent Number: 5,584,341

[45] Date of Patent: Dec. 17, 1996

[54] PLATE BUNDLE FOR A HEAT EXCHANGER

[75] Inventors: Dominique Sabin, Herbeville; Carlos De Costa, Paris, both of France

[73] Assignee: Packinox, Paris, France

[21] Appl. No.: 563,469

[22] Filed: Nov. 28, 1995

[30] Foreign Application Priority Data

Nov. 28, 1994 [FR] France ..... 94 14231

[51] Int. Cl.[6] ..... F28F 3/08

[52] U.S. Cl. ..... 165/166; 165/DIG. 356; 165/DIG. 394

[58] Field of Search ..... 165/166

[56] References Cited

U.S. PATENT DOCUMENTS

| | | | |
|---|---|---|---|
| 2,875,986 | 3/1959 | Holm | 165/145 |
| 3,282,334 | 11/1966 | Stahlheber | 165/166 |
| 3,380,517 | 4/1968 | Butt | 165/166 |
| 5,324,452 | 6/1994 | Allam et al. | 165/166 X |

FOREIGN PATENT DOCUMENTS

| | | | |
|---|---|---|---|
| 60-256792 | 12/1985 | Japan | 165/166 |

*Primary Examiner*—Allen J. Flanigan
*Attorney, Agent, or Firm*—Pollock, Vande Sande & Priddy

[57] ABSTRACT

A plate bundle for a heat exchanger, of the type comprising a stack of mutually parallel metal heat-exchange plates (10), each including smooth-surfaced edges and a corrugated central part (11) to form, with the associated heat-exchange plates (10), a double circuit for circulation of two independent fluids in counterflow. The plates (10) are connected to one another at their longitudinal edges by connection means (13) and comprise, a zone of heat transfer and exchange between the fluids and, at their free ends, a zone for inlet and outlet of the fluids. The fluid inlet and outlet zones are formed by the plane ends (10*a*) of the heat-exchange plates (10), between which independent plates (21) provided with reliefs for distributing the fluids in the heat-exchange zone are inserted.

7 Claims, 4 Drawing Sheets

PLATE BUNDLE FOR A HEAT EXCHANGER

FIELD OF THE INVENTION

The subject-matter of the present invention is a plate bundle for a heat exchanger.

BACKGROUND OF THE INVENTION

There are generally two types of heat exchanger.

The first type of heat exchanger includes a bundle of "U-shaped" tubes or a bundle of straight tubes, in which a fluid circulates.

However, this type of exchanger is of expensive design and its thermal efficiency is limited, in view of the fact that the number of tubes depends on the available space, which is restricted in most cases.

The second type of heat exchanger includes a bundle of plates arranged side-by-side and mutually parallel.

The plates, consisting of thin metal sheets, most often made of stainless steel, include smooth-surfaced edges and a central part provided with corrugations via which they are in contact with one another and by which they delimit a double circuit for circulation of two independent fluids in counterflow from one end of the exchanger to the other.

The plates are connected to one another at their longitudinal edges by connection means consisting, for example, of longitudinal braces fixed together by a leaktight weld wall extending over the entire length and over the entire height of the bundle.

In addition, the plates define, a central zone for heat transfer and exchange between the fluids and, on the other hand, at each end of the bundle, a superposition of inlets and outlets for these fluids.

In prior art structure, each plate includes particular corrugations distributed in defined directions on the surface of the plate, which define the central heat transfer and exchange zone as well as the inlets and the outlets.

The inlets and the outlets are therefore formed by a superposition of corrugations which intersect, creating variations in passage cross-section for the fluids and thereby generating perturbations in their flow.

SUMMARY OF THE INVENTION

The object of the invention is to provide a plate bundle for heat exchangers which makes it possible to overcome the drawbacks mentioned above.

The subject-matter of the invention is therefore a plate bundle for a heat exchanger, of the type comprising a stack of mutually parallel metal heat-exchange plates, each including smooth-surfaced edges and a corrugated central part to form, with the associated heat-exchange plates, a double circuit for circulation of two independent fluids in counterflow. The plates are connected to one another at their longitudinal edges by connection means and define, a zone of heat transfer and exchange between the fluids and, at their free ends, a zone for inlets and outlets of the fluids. The fluid inlet and outlet zones are formed by the ends of the heat-exchange plates, between which independent plates provided with reliefs for distributing the fluids in the heat-exchange zone are inserted.

According to other characteristics of the invention:

the set of plane plates and of plates provided with reliefs define, at each end of the bundle, a superposition with at least one inlet for one of the fluids and at least one outlet for the other of the said fluids, each plate provided with reliefs includes at least one zone for guiding one of the fluids to the corresponding circuit and a zone, for weak circulation of this fluid, separated from the fluid zone by at least one transition zone allowing the said fluid to pass between these two zones, the guide zone includes continuous corrugations, the continuous corrugations of the guide zone form, with the plane ends of the heat-exchange plates, fluid-circulation channels of constant cross-section and directed towards the corresponding circuits, the weak-circulation zone includes pins for maintaining separation from the plane ends of the associated heat-exchange plates, the transition zone includes longitudinally discontinuous corrugations forming passages between the guide zone and the weak-circulation zone, the plates provided with reliefs include, at their longitudinal edges, blocks for attachment on and separation from the plane ends of the heat-exchange plates, each set formed by the ends of the heat-exchange plates, the plates provided with reliefs and the blocks is secured in leaktight fashion to the longitudinal edges of the plates forming the transfer and exchange zone by the connection means of these plates.

BRIEF DESCRIPTION OF THE DRAWINGS

The characteristics and advantages of the invention will now be described by way of example and made with reference to the appended drawings, in which.

DETAILED DESCRIPTION

Figure 1:
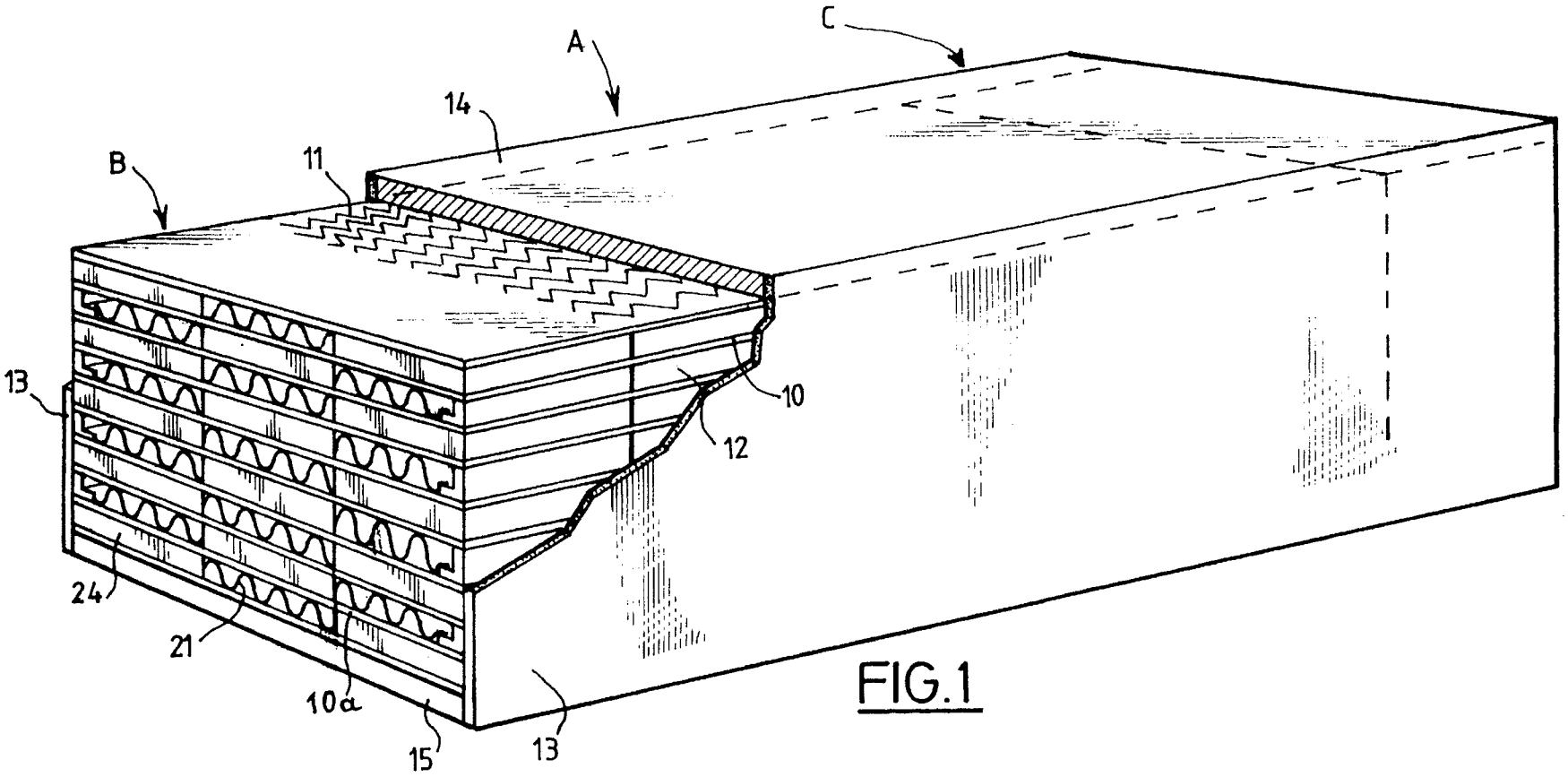
FIG. 1 is a schematic perspective view, partial cut away of a plate bundle according to the invention.

As schematically represented in FIG. 1, the plate bundle for a heat exchanger is composed of three parts, a central part A and two end parts, respectively B and C.

The central part A which constitutes the heat transfer and exchange zone proper is composed of a stack of mutually parallel plates 10.

Each plate 10 consists of A, thin metal sheet, most often made of stainless steel or of any other sufficiently ductile material, and includes, in the conventional way, smooth-surfaced longitudinal and transverse edges and, between these edges, corrugations 11.

The plates 10 define between them a double circuit for circulation of two independent fluids. The heat-exchange fluids circulate longitudinally from one end of the bundle to the other in counterflow.

According to a preferred embodiment, the plates 10 are assembled with one another at their longitudinal edges by connection means consisting, for example, of bars 12 extending over the entire length of the longitudinal edges of the plates 10 and of a weld layer 13 deposited over the entire length and over the entire height of each lateral surface of the bundle, to form a leaktight weld wall.

The stack of plates 10 is placed between an upper metal sheet 14 and a lower metal sheet 15 extending over the entire surface of the plates 10, the peripheries of which are connected to the edges of the said plates 10 by the weld layers 13.

In order to direct the fluids circulating in a counterflow in the central part A from one end of the bundle to the other in the corresponding circuits, this bundle includes, at each of its ends, a zone of inlets and outlets for the fluids, these constitute the end parts B and C of the bundle.

Figure 2:
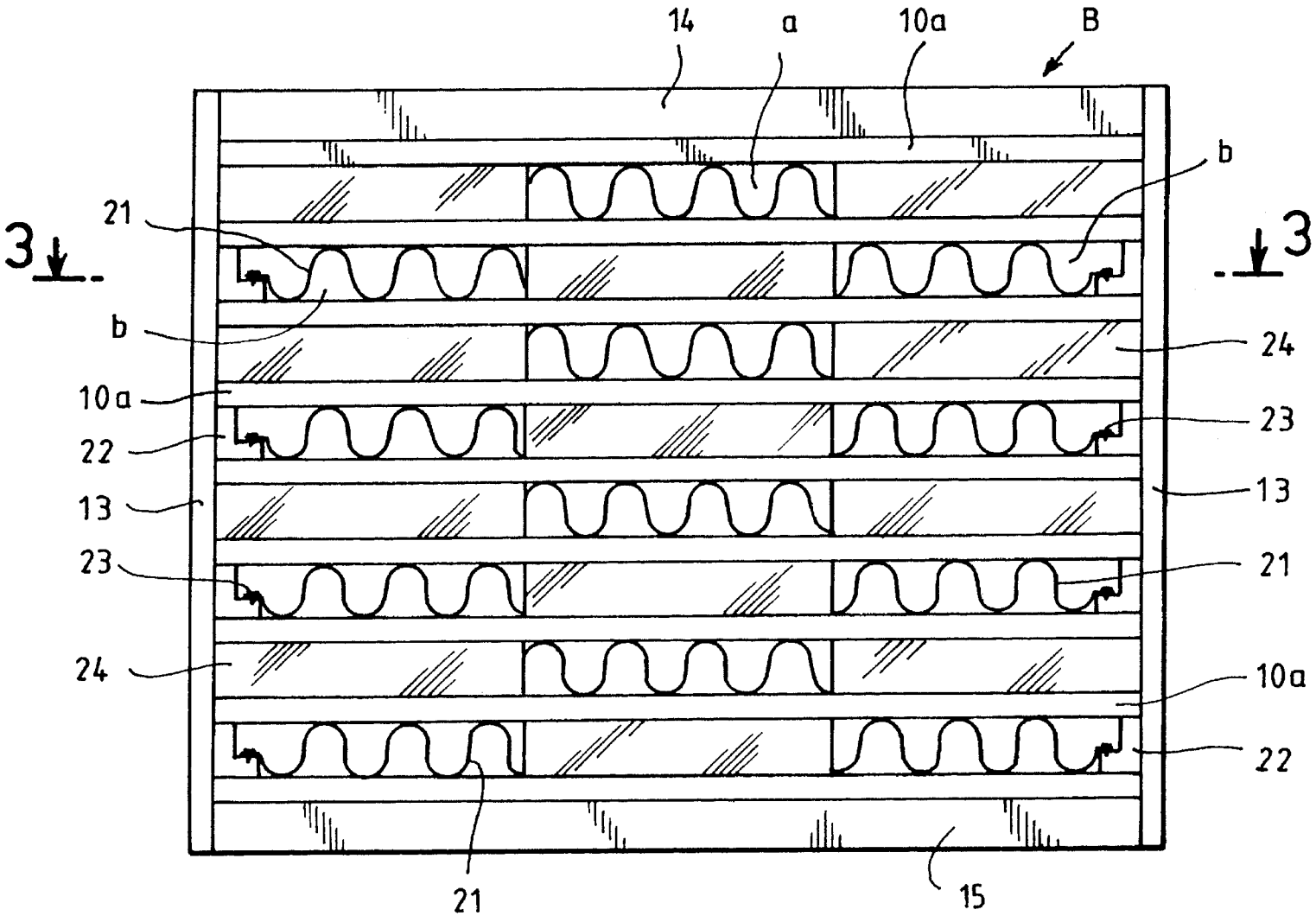
FIG. 2 is a view of one end of the plate bundle according to the invention.
Figure 3:
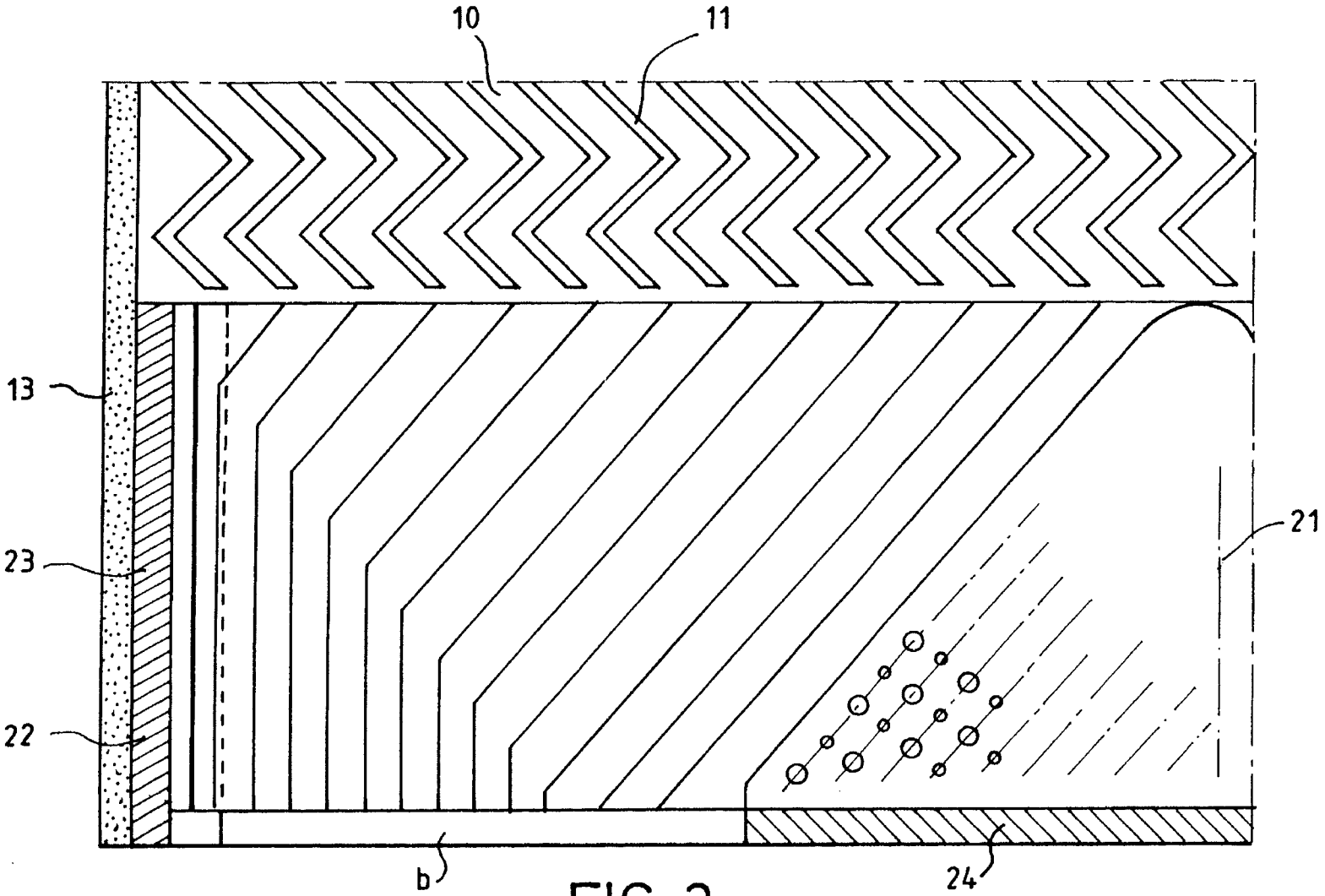
FIG. 3 is a half-view in section along the line 3—3 in FIG. 2.

As represented in FIGS. 2 and 3, these fluid inlet and outlet zones are formed by a stack of the plane ends 10*a* of the heat-exchange plates 10, between which plates 21 provided with reliefs are inserted, these plates 10 constituting the zone of heat transfer and exchange between the fluids.

The set of the plane ends 10*a* of the heat-exchange plates 10 and of the plates 21 provided with reliefs define, at each end of the bundle and at each circuit of the central zone A, at least one inlet (a) for one of the fluids and at least one outlet (b) for the other of the said fluids.

The distribution of the inlets (a) and the outlets (b) at each end of the bundle depends on the characteristics of the fluids and of the heat exchange to be obtained between these fluids.

According to an exemplary embodiment represented in FIG. 2, the inlets and the outlets comprise, at the upper level of the bundle, one inlet (a) for one of the fluids, at the level situated below, two outlets (b) for the other of the fluids, and so on as far as the lower level of this bundle.

As represented in FIGS. 2 and 3, the longitudinal edges plates 21 provided with reliefs include, blocks 22 for fixing on and separation from the plane ends 10*a* of the heat-exchange plates 10.

Each longitudinal edge of the plates 21 provided with reliefs is fixed on a block 22, for example by a weld bead 23.

Each set, formed by the plane ends 10*a* of the heat-exchange plates 10, the plates 21 provided with reliefs and the blocks 22 is secured in leaktight fashion to the longitudinal edges of the plates 10 forming the transfer and exchange zone A, by the connection means of these plates 10, by the weld walls 13.

The portions situated either on each side of the inlets (a) or between the outlets (b) are closed by blocks 24, as represented in FIGS. 2 and 3.

In general, each plate 21 provided with reliefs includes at least one zone for guiding one of the fluids to the corresponding circuit and a zone of weak circulation of this fluid, separated from the guide zone by at least one transition zone allowing the said fluid to pass between these two zones.

Figure 4:
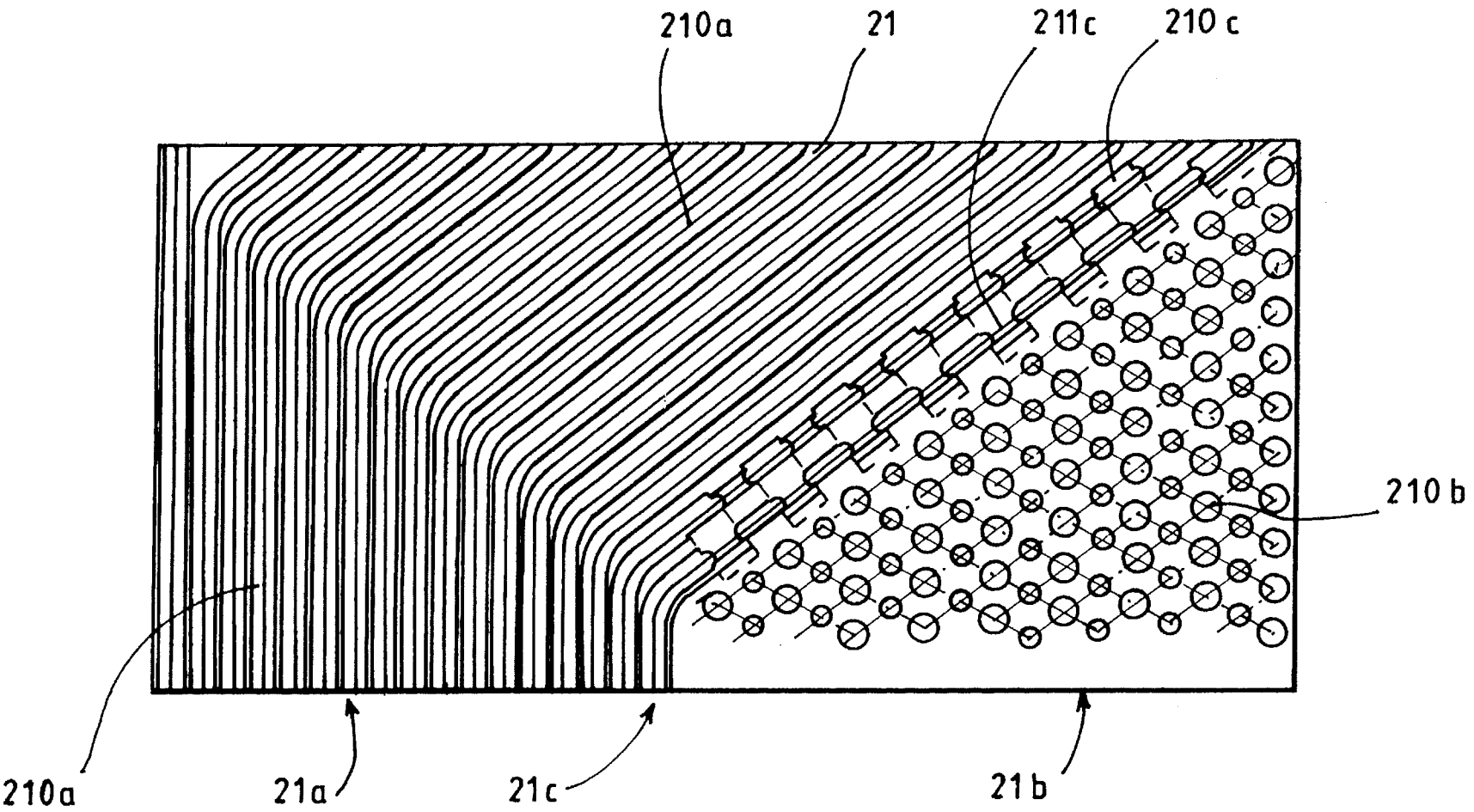
FIG. 4 is a top plan view of an example of a plate provided with reliefs, of an inlet or an outlet of a plate bundle according to the invention.

Referring to FIG. 4, a description will now be given of an exemplary embodiment of a plate 21 provided with reliefs.

The, the plate 21 provided with reliefs includes a zone 21*a* for guiding one of the fluids to the corresponding circuit and a zone 2l*b* for weak circulation of this fluid, separated from the guide zone 21*a* by at least one transition zone 21*c* allowing the fluid to pass between these two zones 21*a* and 2l*b*.

The guide zone 21*a* of the plate 21 includes continuous corrugations 210*a* which form, with the plane ends 10*a* of the heat-exchange plates 10, circulation channels for the corresponding fluid, with constant cross-section and directed towards the circuit in which this fluid circulates.

The weak-circulation zone 2l*b* of the plate 21 includes pins 210*b* for maintaining the separation from the plane ends 10*a* of the associated heat-exchange plates 10.

The transition zone 21*c* includes longitudinally discontinuous corrugations 210*c* forming passages 211*c* between the guide zone 21*a* and the weak-circulation zone 2l*b*.

The transition zone 21*c* ensures passage of a small quantity of fluid from the guide zone 21*a* to the weak-circulation zone 2l*b* so that a small quantity of fluid fills the latter and total stagnation of this fluid is thus avoided in this zone.

The plate bundle according to the invention therefore has, at each of its ends, inlet and outlet zones formed by the plane ends of the heat-exchange plates between which independent plates provided with reliefs that form fluid passages with constant cross-section are inserted, which makes it possible to obtain a uniform flow of the fluids, thus improving the efficiency of the plate bundle.

We claim:

1. Plate bundle for a heat exchanger, of the type comprising a stack of mutually parallel metal heat-exchange plates, each of said heat exchange plates including smooth-surfaced edges and a corrugated central part to form, with associated heat-exchange plates, a double circuit for circulation of two independent fluids in counterflow, said heat-exchange plates having longitudinal edges connected to one another by connection means and comprising a zone of heat transfer and exchange between said fluids and, at free ends of said heat-exchange plates, a zone for inlet and a zone for outlet of said fluids, said fluid inlet and outlet zones being formed by plane ends of said heat-exchange plates, between which independent plates provided with reliefs for distributing said fluids in a heat-exchange zone are inserted, each independent plate being provided with reliefs including at least one zone for guiding one of said fluids to the corresponding circuit and a zone, for weak circulation of said fluid, separated from said guide zone by at least one transition zone allowing said fluid to pass between said guide zone and said circulation zone.

2. Plate bundle according to claim 1, wherein said guide zone includes continuous corrugations.

3. Plate bundle according to claim 2, wherein said continuous corrugations of said guide zone form, with said plane ends of said heat-exchange plates, fluid-circulation channels of constant cross-section and directed towards the corresponding circuits.

4. Plate bundle according to claim 1, wherein said circulation zone includes pins for maintaining separation from the plane ends of associated heat-exchange plates.

5. Plate bundle according to claim 1, wherein said transition zone includes longitudinally discontinuous corrugations forming passages between said guide zone and said weak-circulation zone.

6. Plate bundle according to claim 1, wherein said independent plates provided with reliefs include, at their longitudinal edges, blocks for fixing on and separation from said plane ends of said heat-exchange plates.

7. Plate bundle according to claim 6, wherein each set formed by the plane ends of said heat-exchange plates, said independent plates provided with reliefs and said blocks is secured in leaktight fashion to said longitudinal edges of said heat-exchange plates forming the transfer and exchange zone by said connection means of said heat-exchange plates.

* * * * *